US005156711A

United States Patent [19]

Schwyn

[11] Patent Number: 5,156,711

[45] Date of Patent: Oct. 20, 1992

[54] APPARATUS FOR TREATMENT OF THE SURFACE OF A METAL HOLLOW BODY

[75] Inventor: Bernhard Andreas Schwyn, Luzern, Switzerland

[73] Assignee: Decorex Lizenz AG, Stansstad, Switzerland

[21] Appl. No.: 598,981

[22] Filed: Oct. 17, 1990

[30] Foreign Application Priority Data

Oct. 26, 1989 [CH] Switzerland ..... 3867/89

[51] Int. Cl.[5] ..... B44L 1/16

[52] U.S. Cl. ..... 156/379.7; 156/230; 156/538; 156/539; 156/540

[58] Field of Search ..... 156/230, 233, 234, 238, 156/240, 521, 537, 538, 539, 540, 580, 583.1, 273.9, 379.7

[56] References Cited

U.S. PATENT DOCUMENTS 3,718,517 2/1973 Berg ..... 156/540
4,175,993 11/1979 Robertson ..... 156/540
4,397,710 8/1983 Gaylord ..... 156/249
4,444,613 4/1984 Burmeister ..... 156/456
4,604,154 8/1980 Fosnaught ..... 156/521

*Primary Examiner*—Robert A. Dawson
*Assistant Examiner*—David Reifsnyder
*Attorney, Agent, or Firm*—Bachman & LaPointe

[57] ABSTRACT

Described is a process and apparatus for printing on metal hollow bodies therearound, in particular a can body, by means of thermal transfer printing, wherein color particles disposed on an auxiliary carrier are introduced under the application of heat and pressure by diffusion for example into a dyestuff-affinitive layer on the can body. The process and apparatus are such that the can body is briefly heated with the auxiliary carrier applied thereto and the transfer process which is iniated in that way is then brought to a conclusion at a preferably falling temperature. That provides visually sharp images on the can body, by suppression of the lateral migration of the dyestuff molecules during the transfer operation, to provide a satisfactory closed printing effect at the overlap region of the auxiliary carrier.

10 Claims, 3 Drawing Sheets

APPARATUS FOR TREATMENT OF THE SURFACE OF A METAL HOLLOW BODY

Figure 1:
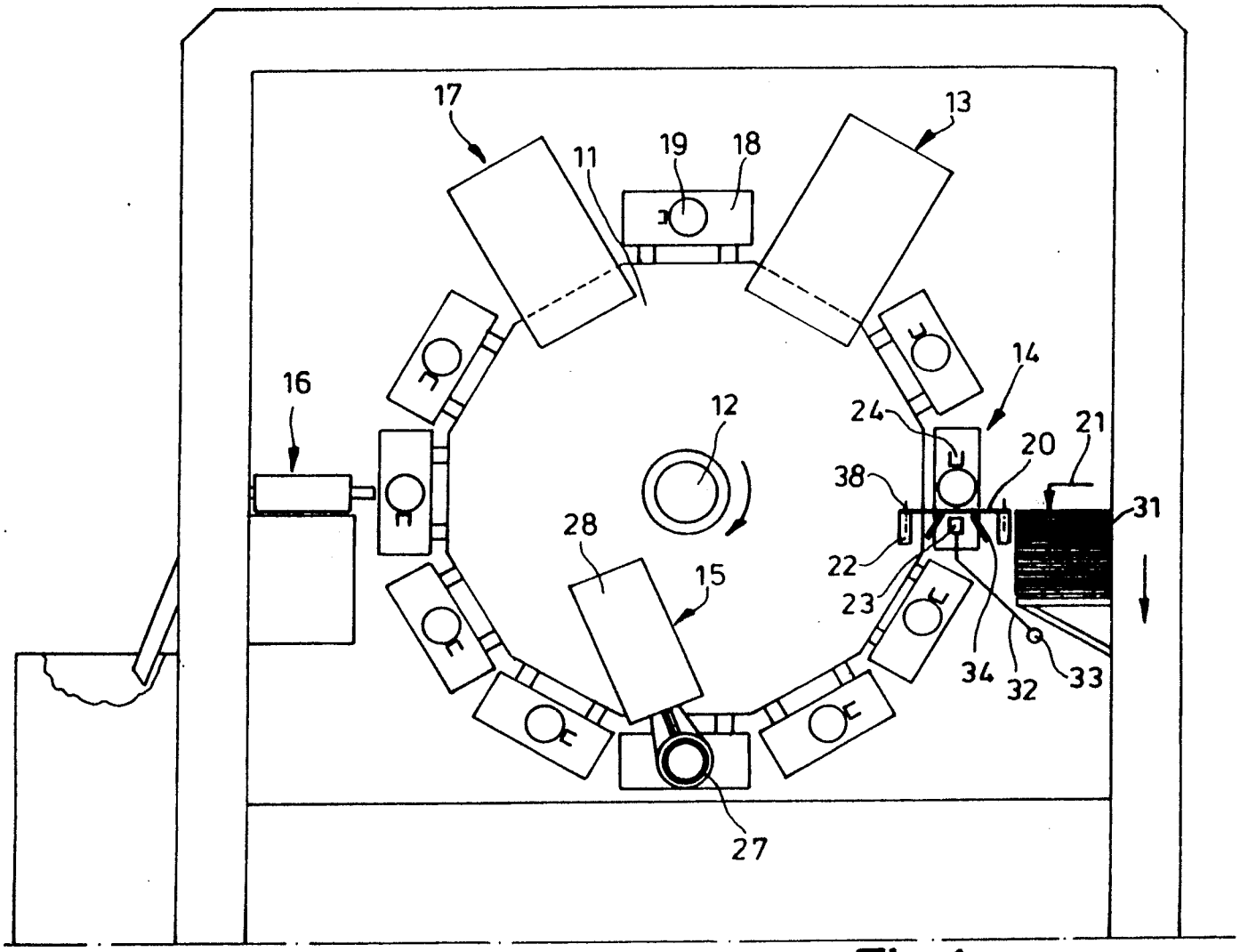

The invention relates to a process and an apparatus for treatment of the surface of a metal hollow body, in particular a can body, by thermal transfer of a motif or design printed on to an auxiliary carrier by means of conventional printing processes and using sublimable organic dyestuffs, on to a dyestuff-affinitive surface coating on the hollow body and a can body produced in that way.

The thermal transfer printing process is used in the decoration of synthetic textiles, plastic materials and solid substrates of ceramic, wood, glass and metal, which have been treated to afford them dyestuff affinity. In that situation the motif or design to be transferred is firstly printed on to an auxiliary carrier, usually paper, in a side-to-side reversed relationship, by means of a conventional multi-colour printing process, using sublimable organic dyestuffs. The auxiliary carrier is applied with its printed side dyestuffs. The auxiliary carrier is applied with its printed side to the dyestuff-affinitive surface of the suitably treated substrate and the temporary composite item produced in that way is heated to a temperature of about 190° C. to 230° C.

The heat energy performs two functions, on the one hand it puts the dyestuff molecules into a gaseous condition, while on the other hand thermal excitation of the substrate coating permits diffusion of the dyestuff molecules into the coating on the substrate.

As is known, with a preheated substrate coating, the operation of transferring a motif or design requires between 1 and 300 seconds, with the duration of the operation being determined in particular by the temperature and the nature of the dyestuffs. The close contact between the auxiliary carrier and the substrate coating, which is usually ensured by the application of external pressure, prevents diffuse transfer of the transfer motif or design.

Besides apparatuses for the thermal printing on substrates, apparatuses of that kind are also known for decorating metal hollow bodies, in particular for decorating cylindrical hollow bodies for the production of what are known as two-part cans which comprise a hollow body closed at its bottom, with a cover or lid which is fitted after the can body has been filled, the cover or lid constituting the second part. At the present time drinks and aerosol cans of aluminium have found wide-spread uses, as two-part cans of that kind. The known apparatuses differ from each other in relation to the nature of transmission of energy to the metal hollow body or transfer composite item and/or the way in which the auxiliary carrier and the hollow body are brought together.

The specification of British patent application No. 2 101 530 discloses an apparatus in which the auxiliary carrier is wound in the form of a label around the hollow body by means of an auxiliary device. The ends of the label are glued by means of a water-soluble adhesive to the surface of the hollow body, which has been treated to make it dyestuff-affinitive. The composite item formed in that way receives the energy required for the thermal transfer effect, as the item passes through a hot air furnace. After the transfer operation has been carried out and the hollow body has been cooled down, the auxiliary carrier is removed from the hollow body by means of a jet of water.

That apparatus does not make it possible to apply printing in the region in which the ends of the label are glued in position. That means that the hollow body with printing thereon has a printing-free strip of greater or lesser width, which has an adverse effect on the overall appearance of the hollow body. The relatively long heating-up time for the composite item, involving the use of hot ambient air, and the long transfer time that that entails, promote lateral migration of the dyestuff molecules in the coating, resulting in lack of sharpness in the transferred motif or design.

In accordance with an apparatus which is known from German laid-open application (DE-OS) No. 32 29 815, cylindrical articles which are provided with a dyestuff-affinitive coating are continuously passed in sequence through a heating zone and simultaneously rolled against an auxiliary carrier which lies in part against the surface of the cylindrical articles, in a tensioned condition. When the side of the auxiliary carrier which has dyestuff printing thereon is in contact with the surface of the cylindrical article, the thermal transfer operation takes place by the auxiliary carrier being heated to a temperature above the sublimation temperature of the dyestuffs. The auxiliary carrier is subjected to a thermal loading prior to the transfer operation, and that results in premature sublimation of a part of the dyestuffs. In addition, the auxiliary carrier is fed to the surface of the cylindrical article in tangential relationship therewith. That procedure thus results in a small region, which is dependent on the diameter of the cylindrical article and in which contact-less transfer takes place, with a reduction in the quality of the printing.

In addition, in that known apparatus, portions of the motif or design which have already been transferred are subjected to a thermal loading for a relatively long period of time, and that results in lateral dyestuff migration in the dyestuff-affinitive surface coating, such migration resulting in lack of sharpness.

German laid-open application (DE-OS) No. 32 28 096 discloses a further apparatus for thermal transfer printing on cylindrical hollow bodies, in which labels carrying the motif or design have their ends glued together in superposed relationship, if their ends overlap each other, while if the ends butt together, they are held together by means of an adhesive strip. That procedure involves the use of adhesives and adhesive strips which decompose at a temperature above the sublimation temperature and thus permit removal of the labels. Continuous decoration of the hollow body in the region in which the ends of the labels butt together is not possible as production tolerances which occur in a practical context in respect of labels and cans prevent the ends from precisely butting together, as does distortion of the label caused by the removal of water therefrom during the transfer operation. When the ends of the label are stuck together in superposed relationship, an air gap remains in front of the inner end of the label, and that results in an incomplete and diffuse transfer effect. The composite items, that is to say the hollow body with the label applied thereto, pass through a first heating zone in which the composite items are slowly heated to the necessary sublimation temperature and then a second heating zone in which the composite items are heated to a suitable temperature for the adhesives. That overall thermal loading results in lateral migration of the dyestuff molecules and thus gives rise to lack of sharpness in the transferred printing.

Taking the foregoing as his basic starting point, the inventor set himself the object of providing a process and an apparatus for treatment of the surface of a metal hollow body, in particular a can body, by thermal transfer of a motif or design which is printed on an auxiliary carrier by means of conventional printing processes using sublimable organic dyestuffs, on to a dyestuff-affinitive surface coating on the hollow body, and also a can body, which, to overcome the disadvantages known from the state of the art, permit and provide for complete decoration, extending around the periphery of a hollow body, in the sense of an at least monochromic colour transfer in the region where the ends of the auxiliary carrier butt together or overlap, and that object is attained in accordance with the invention by the features set forth in claims 1, 3 and 22.

The invention therefore provides for the first time motif or design configurations on hollow bodies of cylindrical or polygonal nature, the printing quality of which corresponds to the known excellent printing quality involved with motifs or designs applied to substrates, that is to say flat articles. In addition, the invention eliminates printing-free strips which extend on the surface in the longitudinal direction, and strips of contact-less transfer. Hitherto strips of that kind have imposed aesthetically motivated limits on procedures for producing thermal printing on hollow bodies, and those limits have now been overcome.

In accordance with a desirable development of the invention the mandrels with hollow bodies and auxiliary carriers, after the transfer operation has been effected, are subjected to a cooling effect which can be performed for example by means of the air while steps in the cycle progress, whereby lateral migration of the molecules is substantially suppressed, to provide sharp motif images.

The heating station may comprise inductors of a bar-like or half-shell configuration, which are arranged in a stationary fashion and with which medium or high frequency can be passed into the hollow body. However in order to achieve the fast intensive heating of the hollow body, which is the aim of the invention, it is preferable for the heating station to comprise an induction coil which passes over the mandrel with hollow body and auxiliary carrier, by means of an axial stroke movement, which surprisingly also results in a level of printing quality which is more uniform than when the mandrel with hollow body passes through the induction coil.

When using an induction coil which passes over the tubular body, the heating operation can be effected by using high or medium frequency.

The use of high frequecy is preferred, in contrast to the use of medium frequency, in regard to the part of the process which takes place at a falling temperature, involving the transfer operation, if, with process parameters according to the invention which are otherwise the same, such as the overall duration of the transfer operation, there is a wish to provide for accelerated removal of heat from the preheated composite volume. If in comparison therewith a slower rate of removal of heat is indicated, the use of medium frequency is to be preferred.

In another advantageous configuration according to the invention the induction coil is in the form of an annular coil which concentrically surrounds the hollow body, being of shorter axial extent, for passing over the ends of the hollow body. That ensures that a hollow body passes unimpededly into the heating station while overheating of the tubular body is avoided. Overheating would occur if the induction coil were to perform a reverse stroke movement without passing completely over the hollow body, for example beyond the open end thereof.

In order to guarantee a uniform temperature distribution in and along the peripheral wall of a hollow body which is closed at one end by means of a bottom, the invention further provides that the output of energy by the induction coil is adapted to be automatically controllable, during the stroke movement, in accordance with a predetermined output-time function.

More specifically, when dealing with hollow bodies which are closed at one end, a problem which arises is that, with a uniform input of energy from the bottom to the opening of the hollow body, a non-uniform distribution of temperature in the longitudinal direction occurs over the peripheral wall of the hollow body, insofar as the temperature at the bottom is lower than at the opening of the hollow body. In accordance with the invention that non-uniform temperature distribution is prevented in that more energy is applied to the hollow body at the bottom than at the opening by way of control in respect of the output of energy from the coil, with a speed of movement over the hollow body which remains the same. That ensures uniform transfer conditions as between the bottom and the opening.

In accordance with a further development of the invention the output of energy of the induction coil to the hollow body, which is synchronised with the stroke movement, lasts for less than 1000 milliseconds, preferably from 200 to 400 milliseconds, which results in heating of the metal hollow body from ambient temperature to from 150° C. to 250° C. but preferably to from 210° C. to 230° C. That advantageous, brief shock-like heating of the hollow body together with the auxiliary carrier to temperatures which are required for the thermal transfer process, as can be achieved with the apparatus according to the invention, prevents dyestuff molecule pre-sublimation effects, which result in lack of definition of the printed motif, and also prevents lateral migration of the dyestuff molecules in the dyestuff-affinitive layer, those being phenomena which occur when using long heating times.

In accordance with another advantageous configuration of the invention, heatable, energy-conducting mandrels are provided for the transfer of contact heat to the inside of the hollow body. In that way it is possible for hollow bodies with an auxiliary carrier to be heated prior to and during the application of the frequency energy to from 150° C. to 250° C., preferably from 210° C. to 230° C., in order to reduce the length of the heating operation. A comparable result is achieved if the mandrels are of a heat-insulating configuration. Mandrels which have a heat-insulating effect are kept for that purpose in a temperature range of from 100° C. to 150° C., preferably from 110° C. to 130° C. Besides the reduction in the length of the heating period, that advantageously also provides that the frequency energy supplied remains concentrated at the surface of the hollow body for the purposes of heating up the dyestuff-affinitive layer and the auxiliary carrier to the dyestuff molecule sublimation temperature, and does not flow away into the mandrel through the wall of the hollow body, in substantial amounts.

The apparatus according to the invention is advantageously of such a configuration that, for the purposes of printing around the article, the auxiliary carrier is applied in a tensioned condition around the periphery of the hollow body, and the overlap region consisting of the ends of the auxiliary carrier is held under pressure against the surface involved. In that way the auxiliary carrier bears entirely under pressure against the peripheral surface, and that pressure increases if the auxiliary carrier shrinks during the heating operation, due to the removal of water. In accordance with the invention, the auxiliary carrier is pressed against the hollow body in the above-indicated manner by virtue of the feature that the holding finger is of at least the same axial dimension as the mandrel and is adapted to be movable with respect to the surface of the mandrel.

In accordance with another advantageous configuration the holding finger is made entirely from materials which do not experience a coupling effect in a medium or high frequency field.

That prevents the region of the auxiliary carrier which is under the holding finger from being heated to a greater degree than the remainder of the auxiliary carrier. For that purpose it has been found advantageous for the holding fingers to comprise glass fibre-reinforced, high temperature-resistant polymers, and to present high torsional and bending strength.

In accordance with the invention there is provided a loading station which loads hollow bodies on to mandrels which are arranged in a circular array and at equal spacings on the turntable. Also in accordance with the invention there is provided a station for removing the auxiliary carriers from the hollow body, upstream of an unloading station. In the unloading station the hollow bodies with printing thereon are removed from the mandrels and from there passed on for a further processing operation.

In accordance with the process according to the invention the thermal transfer process is set to a process duration of from 1 to 10 seconds, preferably from 2 to 4 seconds. A process duration of that order of magnitude is particularly advantageous for the high-quality transfer process printing which the invention seeks to provide.

Figure 2:
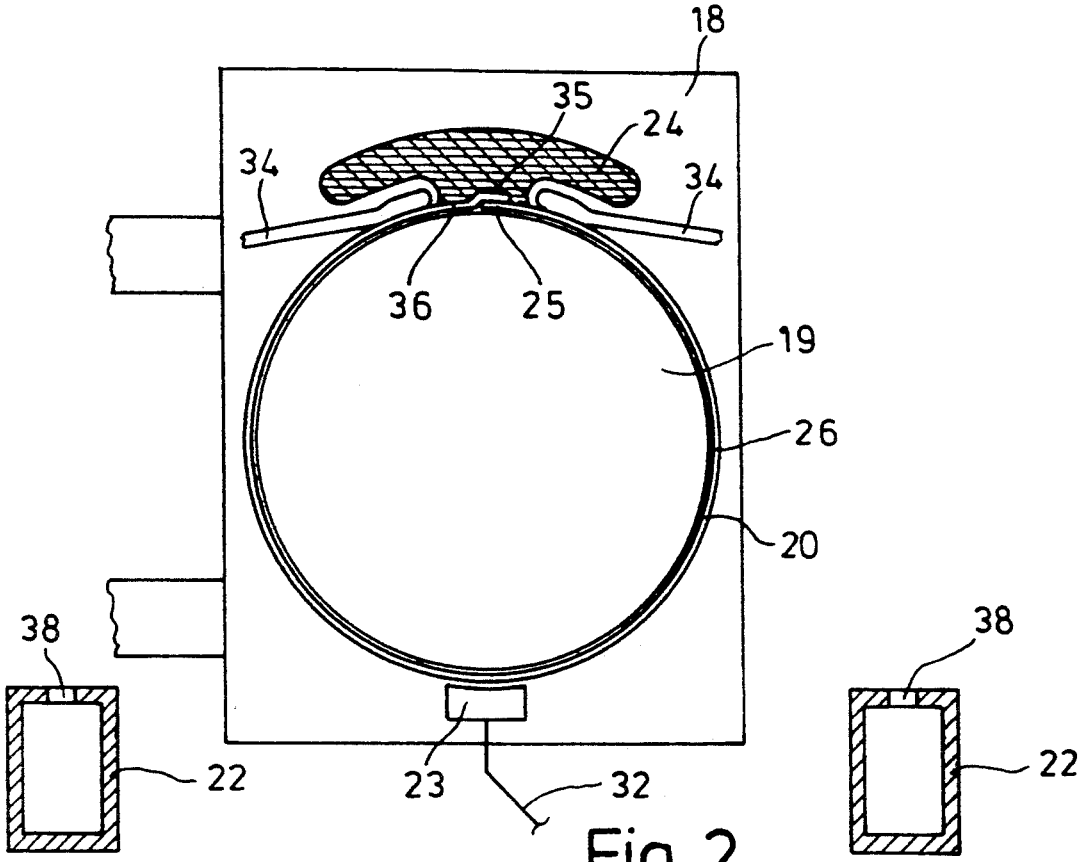
Figure 3:
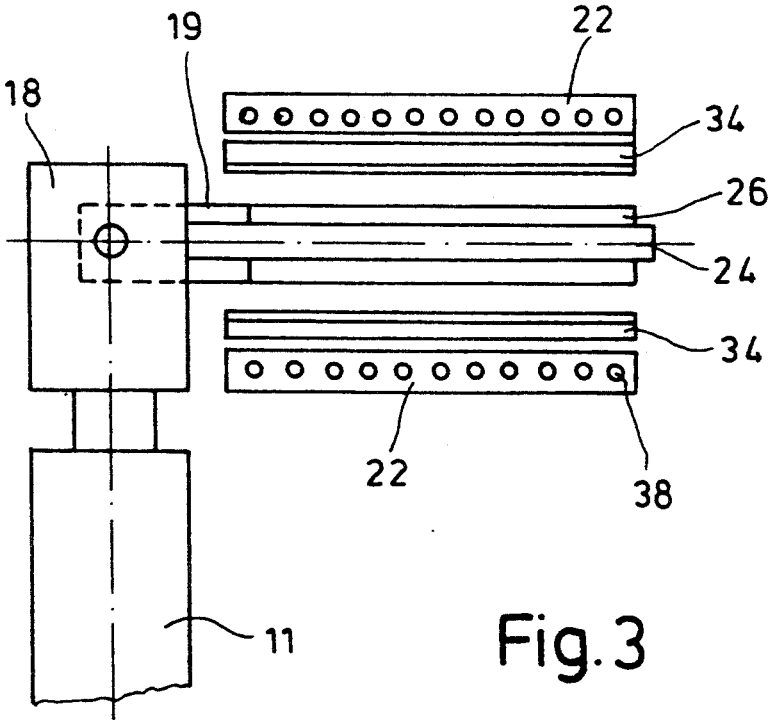
Figure 4:
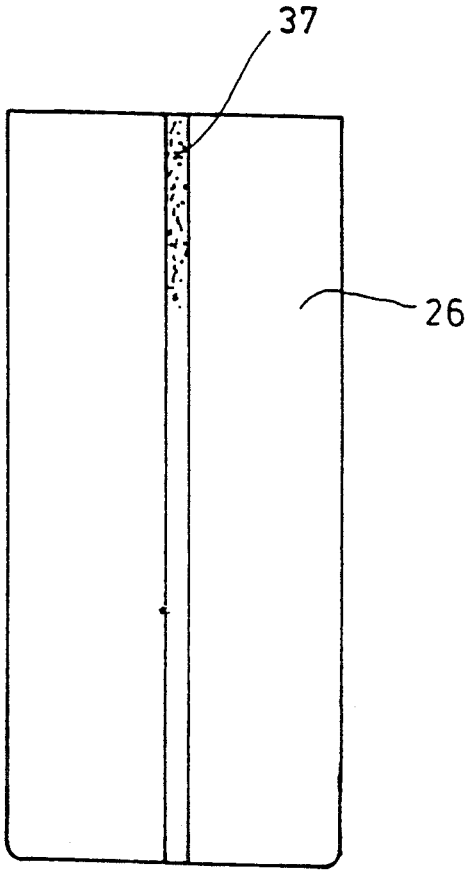

Further advantages, features and details of the invention will be apparent from the following description of a preferred embodiment of an apparatus for carrying out the process, that is to say for printing on a can body which is closed at one end, and with reference to the drawings in which:

FIG. 1 is a diagrammatic front view of an apparatus for carrying-out the process according to the invention in the form of a vertically disposed turntable, FIG. 2 is a diagrammatic front view of a detail of the wrapping apparatus according to the invention with can body, auxiliary carrier and wrapping blades, in the terminal operative position, FIG. 3 shows a plan view of the FIG. 2 apparatus with the wrapping blades in a retracted position, and FIG. 4 is a side view of a can.

The preferred apparatus 10 according to the invention comprises a vertically arranged turntable 11 which is driven in a cyclic movement about an axis 12. Co-operating with the turntable 11 are a loading station 13, a wrapping station 14, a heating station 15, a station 16 for the removal of auxiliary carriers 20, and an unloading station 17.

The loading station 13, the wrapping station 14, the heating station 15, the station 16 for the removal of the auxiliary carriers 20 and the unloading station 17 are arranged in succession in the direction of rotation of the turntable 11 so that a can body 26 passes in a cyclic movement on a circular path through the apparatus 10, in the above-indicated sequence. Along its periphery at uniform spacings from each other, the turntable 11 carries mandrel holders 18 which bear mandrels 19 which extend perpendicularly to the surface of the turntable 11.

In the loading station 13 can bodies are pushed on to the mandrel 19 which has moved into the loading station 13, by means of a conveyor device (not shown) which is movable in parallel-axis relationship with the mandrel 19, and the can bodies 26 are then moved to the winding station 14 in the cyclic steps of the procedure.

In the present embodiment the turntable 11 carries for example twelve mandrels 19 which are arranged in a circular and concentric array around the axis 12 so that, with the illustrated arrangement of the loading station 13 and the unloading station 17 which are each arranged at an angle of 15° relative to the vertical axis of the turntable 11 and which form between them an angle of 30°, the mandrel 19 which is loaded with a can body 26 requires in the present case two cycle steps in order to pass into the wrapping station 14.

In the wrapping station 14 a can body 26 encounters an auxiliary carry 20, in the direction of rotation of the turntable 11. Before the can body passes into the wrapping station 14, the auxiliary carriers are conveyed by a diagrammatically illustrated forward feed device 21 in a horizontal direction from a stack 31 of auxiliary carriers on to two support bars 22 between which is disposed a position holding means 23.

The support bars 22 which are of at least the same length as the mandrels 19 hold the auxiliary carrier 20, by the auxiliary carrier 20 being sucked into position by the support bars 22 by means of a vacuum. For that purpose the support bars 22 are in the form of hollow members which are connected to a vacuum pump, wherein the support surfaces of the support bars 22 have bores 38 by way of which the vacuum can take effect, when an auxiliary carrier 20 is disposed thereon. The support bars 22 are arranged beneath a mandrel 19 which has moved into the wrapping station 14, at a spacing which is determined by half the diameter of the mandrel 19 with the can body 26 thereon, and the thickness of the auxiliary carrier 20. The outside lateral spacing of the support bars 22 from the perpendicular centre line of the mandrel 19 corresponds to half the width of the auxiliary carrier 20, in which respect the expression the width of the auxiliary carrier 20 means the side length which corresponds to the circumference of the can body 26 including additional portions to the side length for forming the overlap region 25. The position holding means 23 of at least the same length as the mandrel 19 is arranged centrally between the support bars 22 in the operative position, is in contact with the side of the auxiliary carrier 20 which is remote from the can body 26, and is adapted to be movable by way of a lever 32 about a pivot mounting 33. Disposed between the position holding means 223 and each of the two support bars 22 is a wrapping blade 34 of the same lengthwise dimension as the support bars 22.

Also co-operating with the mandrel 19 is a holding finger 24 of at least the same length as the mandrel 19. The holding finger 24 is disposed above the mandrel 19 and is adapted to be movable in a perpendicular direction so that it can be brought into engagement with the overlap region 25 of the auxiliary carrier 20, thereby pressing it against and releasing it from the outside peripheral wall surface of a can body 26.

A can body 26 which is carried on the mandrel 19 passes into the wrapping station 14 and is there brought together with an auxiliary carrier 20 which is disposed on the support bars 22 and the position holding means 23. The position holding means 23 presses the auxiliary carrier 20 against the can body 26 in order to prevent the auxiliary carrier 20 from moving during the wrapping operation relative to the surface of the can body 26.

After the vacuum is removed, each of the wrapping blades 34 passes around approximately half of the outside periphery of the can body and thus applies the auxiliary carry 20 to the can body 26, forming a non-formed overlap 25 from the longitudinal edges of the auxiliary carrier 20, which correspond to the length of the can body 26. The wrapping blades 34 lay the auxiliary carrier 20 around the periphery of the can body 26 so that the auxiliary carrier 20 is in a tensioned condition. When the wrapping blades 34 have reached their terminal operative position, forming a non-formed overlap under the holding finger 24, the holding finger 24 is moved in a vertical direction. In so doing, the holding finger 24 presses the overlapping ends together and thus provides a formed overlap 25 which extends in the axial direction, with the shape and dimensions of the overlap 25 corresponding to a recess 35 of corresponding configuration at the inside surface of the holding finger 24. At the same time the edge regions of the auxiliary carrier 20, which adjoin the overlap 25, are pressed against the can body 26 by the walls 36 which delineate the recess 35 in the longitudinal direction of the mandrel 19; in accordance with the invention, that essentially contributes to a qualitatively superior transfer printing effect also in the overlap region.

After the overlap 25 and the edge regions have been subjected to the shaping and pressing steps, the wrapping blades 34 and the position holding means 23 retract so that the overlap 25 and the edge regions are held pressed against the can body 26.

After the return pivotal movement of the position holding means 23 and the wrapping blades 34, the can body 26 which is provided with an auxiliary carrier 20 in the wrapping station 14 is passed to the heating station 15, with holding finger 24 following. It is also possible for a plurality of heating stations 15 to be provided in succession in the direction of rotary movement. The heating station 15 comprises a hollow-cylindrical coil 27 of shorter axial extent than the can body 26, the coil 27 co-operating with a stroke-producing device 28. When the can body 26 passes into the positioning arrangement of the heating station 15, the coil 27 is disposed in front of the mandrel 19 with the can body 26 fitted thereon, so as to ensure unimpeded movement into the positioning arrangement. The stroke-producing device 28 then causes the coil 27 to move into position over the can body 26 with holding finger 24, with the inner opening thereof also embracing the open end of the can body 26 completely in the axial direction in the form of a forward and return movement, wherein at the termination of the return movement the coil is again disposed in front of the can body 26 so that the subsequent can body can be passed into the heating means 15. The coil 27 heats the composite item consisting of the can body 26 and the auxiliary carrier 20 inductively, that is to say in a contactless manner, for which purpose the coil is connected to a high or medium frequency generator (not shown). The coil 27 quickly heats the composite item consisting of the cam body 26 and the auxiliary carrier 20, during the forward and return movement of the coil 27, to the temperature required to initiate the transfer process. To avoid overheating of the holding finger 24, the holding finger comprises a non-metallic material, preferably a polyimide or a ceramic material.

The output of energy from the coil 27 may take place during the stroke movement in accordance with a predetermined output-time function, wherein when the coil 27 initially travels over the closed end of the can body, the coil 27 introduces more energy thereinto in order to compensate for the greater amount of heat absorbed by the can body, in comparison with the can wall, during the traversing movement of the coil 27. In accordance with the invention the absorption of heat by the bottom of the can body can be reduced if, before passing into the heating station 15, the can bottom is subjected to the effect of heat, which can be effected for example by means of a flow of hot or warm air which is directed on to the bottom of the can body.

Energy output which is synchronised with the stroke movement of the coil 27 is to last for less than 1000 milliseconds, preferably from 200 to 400 milliseconds, during which the can body 26 is heated from ambient temperature to from 150° C. to 250° C., preferably from 210° C. to 230° C.

Energy-conducting mandrels 19 can be designed to be heated, at least starting from the loading station 13, to a temperature of from 150° C. to 250° C., preferably from 210° C. to 230° C., transferring that temperature to the inside of the can body 26 by contact heat transfer. In that way it is possible to reduce the length of the heating time and to provide that the energy supplied remains concentrated at the surface of the can body 26 in order to heat up the dyestuff-affinitive layer and the auxiliary carrier 20 to the sublimation temperature of the dyestuff molecules, and does not flow away in a substantial amount through the peripheral wall of the can body into the mandrel 19.

A comparable effect is achieved if the contact heat transfer effect is produced by means of mandrels 19 which have an insulating action and which are kept in a temperature range of from 110° C. to 150° C., preferably a temperature range of from 110° C. to 130° C. Mandrels which have an insulating effect, that can be considered in this connection, are mandrels of non-metallic materials, for example plastic materials, the coefficients of thermal conductivity of which are substantially lower than the coefficients of thermal conductivity of the materials of the can bodies.

It has been found that mandrels 19 of that kind achieve their best possible effect when they are kept at the specified temperatures.

In the heating station 15 the thermal transfer procedure is initiated by abrupt heating, in which situation the dyestuff molecules disposed on the auxiliary carrier 20 comprising paper or plastic foil vaporise and diffuse into the dyestuff-affinitive layer on the surface of the can body 26.

The dyestuff-affinitive layers that may be considered comprise layers consisting of epoxy resins, silicone resins, phenoplasts, aminoplasts, low-. medium- and also high-molecular dyestuffs. Desirable dyestuff groups are monoazo and azomethine dyestuffs whose molecules can be heavily filled with amino, alkoxy, nitro, halogen and cyano groups.

In accordance with the invention the thermal transfer process, after the introduction of energy in the heating station 15, is adjusted to a process duration of from 1 second to 10 seconds, preferably to from 2 seconds to 4 seconds, and takes place after the heating operation, without the further supply of heat, at a falling temperature. That procedure has been found to be particularly advantageous for high-quality transfer printing effects.

That part of the procedure takes place between the heating station 15 and the apparatus 16 for removal of the auxiliary carriers 20, into which the can bodies pass in steps in the cycle. The apparatus 16 for removal of the auxiliary carriers 20 comprises an air guide nozzle 29 which extends in a direction towards the can body which has passed thereinto, and which, after the holding finger 24 has been lifted off the overlap 25, removes the auxiliary carrier 20 from the can body 26 by means of a stream of air, whereby the sublimation transfer operation is concluded. A vacuum suction removal device 30 picks up the auxiliary carriers 20 which have been blown off the can bodies, to take them away from the station 16.

From the apparatus 16 a can body 26 which has now been provided with its finished printing is passed to the unloading station 17 in which the can body 26 is removed from the mandrel 19 by means which are not shown, and transferred to further devices for it to be transported away.

By means of the apparatus according to the invention it has now been made possible for printing to be applied to can bodies entirely around same, with a high level of printing quality, by means of a thermal transfer printing process. At the same time it is possible for the quality of the transfer printing in respect of the overlap region to be so outstanding that that printed portion no longer has an adverse effect as hitherto on the overall appearance and impression of a can with printing thereon, which is due to the fact that, by virtue of suitable pressing, heating and other procedure as described above, the dyestuff particles in the region of the overlap forming a printing strip 37 are of the same or lower level of colour intensity as the particles outside the overlap.

I claim:

1. Apparatus for carrying out a process for treatment of the surface of a metal hollow body by thermal transfer of a design or motif which is printed on an auxiliary carrier by means of conventional printing processes and using sublimable dyestuffs onto a dyestuff-affinitive surface coating on the hollow body, said apparatus including:

a turntable (11) arranged in a vertical plane, said turntable adapted to be driven in cycle steps;

a plurality of mandrels (19) arranged at an outer periphery of the turntable (11) perpendicularly to a face of the turntable, for holding hollow bodies (26);

holding fingers (24) co-operating with the mandrels (19);

a wrapping station (14) for wrapping auxiliary carriers (20) around the hollow bodies (26); and at least one heating station (15) arranged downstream of the wrapping station (14) in the direction of rotation of the turntable (11), for initiating the thermal transfer process, the at least one heating station (15) comprising at least one induction coil (27) which passes over a respective one of the mandrels (19) by means of an axial stroke movement.

2. Apparatus as set forth in claim 1 wherein the mandrels (19) with the hollow bodies (26) and the auxiliary carriers (20) are subjected to a cooling effect following the at least one heating station (15) in the direction of rotation of the turntable (11).

3. Apparatus as set forth in claim 1 further comprising the at least one induction coil (27) being in the form of an annular coil which concentrically surrounds the hollow body (26) and which is of shorter axial extent than the hollow body (26) and which passes over the ends of the hollow body (26).

4. Apparatus as set forth in claim 1 wherein the output of energy from the at least one induction coil (27) is adapted to be automatically controllable during the stroke movement in accordance with a predetermined output-time function.

5. Apparatus as set forth in claim 1 wherein the energy output of the induction coil (27) to the hollow body (26), which is synchronised with the stroke movement, is adapted to be adjusted to less than 1000 milliseconds, preferably to from 200 to 400 milliseconds, for heating of the metal hollow body (26) to from 150° C. to 250° C. but preferably to from 210° C. to 230° C.

6. Apparatus as set forth in claim 1 wherein the mandrels are energy-conducting mandrels (19) and are heatable for the transfer of contact heat.

7. Apparatus as set forth in claim 1 further comprising the mandrels (19) being of a heat-insulating material.

8. Apparatus as set forth in claim 1 further comprising each of said holding fingers (24) having at least the same axial dimension as each of the mandrels (19) and each holding finger being adapted to be movable relative to the surface of a respective one of the mandrels (19).

9. Apparatus as set forth in claim 1 further comprising each of said holding fingers (24) being made entirely from materials which do not experience a coupling effect in a medium or high frequency field.

10. Apparatus as set forth in claim 1 further comprising each of said holding fingers (24) being made entirely or partially from glass fibre-reinforced and high temperature-resistant polymers and having a high level of torsional and bending strength.

11. Apparatus as set forth in claim 1 further comprising the mandrels (19) being arranged in a circular array and at equal spacings on the turntable (11).

12. Apparatus as set forth in claim 1 further comprising the mandrels (19) being loaded with tubular bodies (26) in a loading station (13).

13. Apparatus as set forth in claim 1 further comprising a station (16) for removal of a respective auxiliary carrier (20) from a respective tubular body (26).

14. Apparatus as set forth in claim 13 further comprising an unloading station (17) for removing a respective tubular body (26) from a respective mandrel (19) being disposed downstream of said removal station (16).

15. Apparatus as set forth in claim 1 further comprising the wrapping station (14) including a position holding means (23) which can be brought into engagement with a respective one of the mandrels (19), two support bars (22) which centrally accommodate the position holding means between them and between the position holding means (23) and each support bar (22) a wrapping blade which is movable about half the periphery of said respective one of the mandrels (19).

16. Apparatus as set forth in claim 1 further comprising each of the holding fingers (24) having on a side which is toward a respective hollow body a recess (35) extending in its axial direction for shaping and pressing an overlap (25), with two walls (36) which delineate the recess (35), extending in the same direction, for pressing the edge regions of the overlap (25) against the respective hollow body (26).

17. Apparatus for carrying out a process for treatment of the surface of a metal hollow body by thermal transfer of a design or motif which is printed on an auxiliary carrier by means of conventional printing processes and using sublimable dyestuffs onto a dyestuff-affinitive surface coating on the hollow body, said apparatus including:

a turntable (11) arranged in a vertical plane, said turntable adapted to be driven in cycle steps;

a plurality of mandrels (19) arranged at an outer periphery of the turntable (11) perpendicularly to a face of the turntable for holding hollow bodies (26);

holding fingers (24) co-operating with the mandrels (19);

a wrapping station (14) for wrapping auxiliary carriers (20) around the hollow bodies (26);

at least one heating station (15) arranged downstream of the wrapping station (14) in the direction of rotation of the turntable (11), for initiating the thermal transfer process, the at least one heating station (15) comprising at least one induction coil (27) which passes over a respective one of the mandrels (19) by means of an axial stroke movement; and the at least one induction coil (27) is in the form of a medium frequency coil.

18. Apparatus for carrying out a process for treatment of the surface of a metal hollow body by thermal transfer of a design or motif which is printed on an auxiliary carrier by means of conventional printing processes and using sublimable dyestuffs onto a dyestuff-affinitive surface coating on the hollow body, said apparatus including:

a turntable (11) arranged in a vertical plane, said turntable adapted to be driven in cycle steps;

a plurality of mandrels (19) arranged at an outer periphery of the turntable (11) perpendicularly to a face of the turntable, for holding hollow bodies (26);

holding fingers (24) co-operating with the mandrels (19);

a wrapping station (14) for wrapping auxiliary carriers (20) around the hollow bodies (26);

at least one heating station (15) arranged downstream of the wrapping station (14) in the direction of rotation of the turntable (11), for initiating the thermal transfer process, the at least one heating station (15) comprising at least one induction coil (27) which passes over a respective one of the mandrels (19) by means of an axial stroke movement; and the at least one induction coil (27) is in the form of a high frequency coil.

* * * * *